US009351527B1

(12) United States Patent
Costanza

(10) Patent No.: US 9,351,527 B1
(45) Date of Patent: May 31, 2016

(54) MOCK SLEEVE

(76) Inventor: Susan Costanza, Boyton Beach, FL (US)

( * ) Notice: Subject to any disclaimer, the term of this patent is extended or adjusted under 35 U.S.C. 154(b) by 731 days.

(21) Appl. No.: 13/467,805

(22) Filed: May 9, 2012

Related U.S. Application Data

(60) Provisional application No. 61/504,191, filed on Jul. 2, 2011.

(51) Int. Cl.

| | |
|---|---|
| ***A41D 27/12*** | (2006.01) |
| ***A41D 27/26*** | (2006.01) |
| ***A41C 3/08*** | (2006.01) |
| ***A41C 3/00*** | (2006.01) |
| ***A41F 15/02*** | (2006.01) |
| ***A41D 27/10*** | (2006.01) |

(52) U.S. Cl.
CPC ..... *A41F 15/02* (2013.01); *A41D 27/10* (2013.01)

(58) Field of Classification Search
CPC ..... A41F 15/007; A41F 15/02; A41F 15/00; A41F 15/002; A41F 1/002; A41F 15/005; A41D 27/26; A41D 27/08; A41D 27/10; A41D 1/22; A41C 3/08; A45F 3/12
USPC ..... 450/30, 86; 2/59, 243.1, 268, 459
See application file for complete search history.

(56) References Cited

U.S. PATENT DOCUMENTS

| | | | | |
|---|---|---|---|---|
| 2,699,550 | A * | 1/1955 | Freid | 2/460 |
| 4,469,095 | A * | 9/1984 | Herrera | 602/63 |
| 5,042,089 | A * | 8/1991 | Carmer | 2/55 |
| 5,068,924 | A * | 12/1991 | Ross | A41D 27/26 2/268 |
| 5,308,278 | A * | 5/1994 | Huang | A41D 27/26 2/101 |
| 5,626,507 | A * | 5/1997 | Gillen | 450/86 |
| 6,665,876 | B1 * | 12/2003 | Newman | 2/59 |
| D577,476 | S * | 9/2008 | Hyde | D2/706 |
| 7,429,206 | B2 * | 9/2008 | Perry | 450/86 |
| 2005/0039243 | A1 * | 2/2005 | Henderson | 2/327 |
| 2006/0089081 | A1 * | 4/2006 | Peay | 450/1 |
| 2007/0028345 | A1 * | 2/2007 | McCarty | A41D 13/08 2/59 |
| 2008/0092265 | A1 * | 4/2008 | Gage et al. | 2/69 |
| 2009/0007315 | A1 * | 1/2009 | Karon | A41C 3/00 2/268 |
| 2009/0117826 | A1 * | 5/2009 | Crouch | 450/86 |
| 2012/0297516 | A1 * | 11/2012 | Elliot | 2/69 |
| 2012/0324615 | A1 * | 12/2012 | Heimann | 2/69 |
| 2013/0047311 | A1 * | 2/2013 | Morency | 2/46 |
| 2013/0185845 | A1 * | 7/2013 | Decker | A41D 27/10 2/243.1 |
| 2014/0082828 | A1 * | 3/2014 | Bill | 2/243.1 |
| 2014/0273736 | A1 * | 9/2014 | Seiler | A41D 1/22 450/30 |
| 2015/0033451 | A1 * | 2/2015 | Bradshaw | A41D 27/10 2/243.1 |

FOREIGN PATENT DOCUMENTS

| | | | |
|---|---|---|---|
| FR | 930197 | A * | 1/1948 |
| GB | 687377 | A * | 2/1953 |

* cited by examiner

*Primary Examiner* — Alissa L Hoey
*Assistant Examiner* — Jameson Collier
(74) *Attorney, Agent, or Firm* — Daniel S. Polley, P.A.

(57) ABSTRACT

An attachable/detachable sleeve removably secured to the bra strap of the wearer before the wearer puts on the desired article of clothing. The sleeve can be constructed of a sheer fabric, such as, but not limited to, a chiffon-like material, that drapes over the shoulder and gives partial concealment or a veil like coverage as a short sleeve in a fashionable manner. With the article of clothing on the wearer, the sleeve appears as if it was always part of the original design of the clothing and the article of clothing covers the securement of the sleeve to the bra strap. The sleeve offers versatility as it can attach and remove easily from the bra strap and provides a unique fashion accessory that creates a comfortable solution to enhance and transform any outfit from daytime to evening.

20 Claims, 10 Drawing Sheets

MOCK SLEEVE

This application claims priority to and the benefit of U.S. Application Ser. No. 61/504,191, filed Jul. 2, 2011, which application is incorporated by reference in its entirety.

FIELD OF THE INVENTION

The invention relates to an attachable mock sleeve which is preferably designed as a fashion accessory solution to give coverage to the shoulder and upper arm area for a person wearing sleeveless clothing.

BACKGROUND OF THE INVENTION

With the variety of fashions that are currently on the market, many clothes are designed to be sleeveless. Currently, for the mature woman who wants to find a fashionable solution that hides problem areas such as the upper arm area, they have no other accessory alternative except for the use of a wrap, scarf or cardigan. The present invention is directed to overcoming this problem currently associated with wearing sleeveless clothing.

SUMMARY OF THE INVENTION

The present invention provides an attachable/detachable mock sleeve which is preferably designed to be secured to the bra strap of the wearer. In a preferred embodiment, the sleeve can be customized to clip on or otherwise attach to the strap of a bra before putting on the desired article of clothing. In a preferred non-limiting embodiment, the sleeve can be constructed of a sheer fabric, such as, but not limited to, a chiffon-like material, that drapes over the shoulder and gives partial concealment or a veil like coverage as a short sleeve in a fashionable manner. Once the article of clothing is put on over the mock sleeve, the sleeve can preferably appear as if it was always part of the original design of the clothing and the article of clothing can preferably cover the securement area or mechanisms used to attach the present invention sleeve to the bra strap. The mock sleeve offers versatility as it can attach and remove easily from the bra strap. Thus, the present invention provides a unique fashion accessory that creates a comfortable solution to enhance and transform any outfit from daytime to evening.

DETAILED DESCRIPTION OF THE INVENTION

Figure 1:
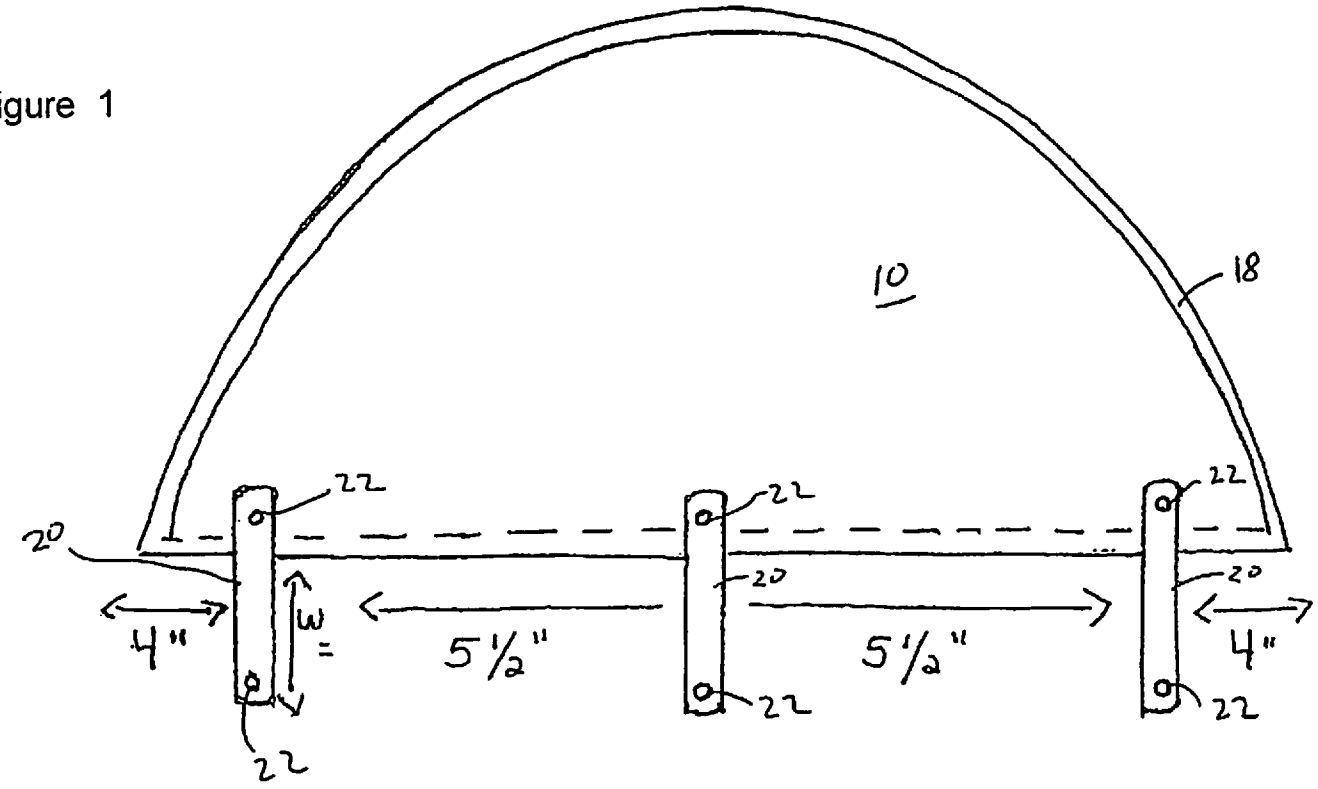
FIG. 1 is a top view of the mock sleeve (panel) in accordance with a first embodiment of the present invention shown in a flat position with non-limiting measurements provided that can be used in one embodiment.
Figure 2:
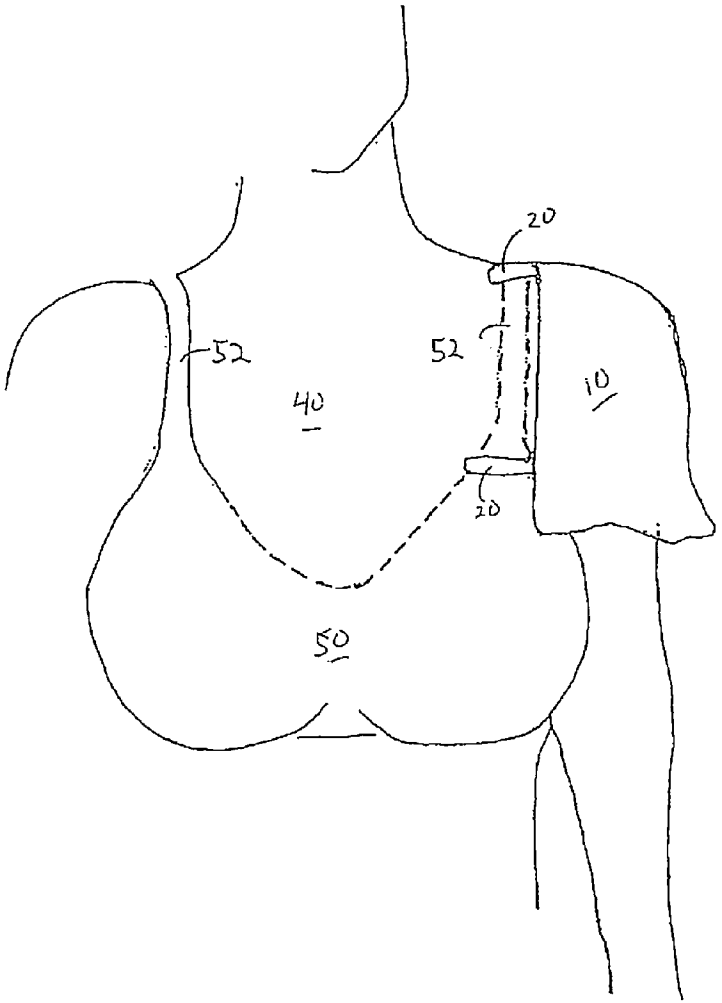
FIG. 2 is a front elevational view of the mock sleeve (panel) of FIG. 1 attached to the strap of the bra as it drapes over the shoulder and upper arm area.
Figure 3:
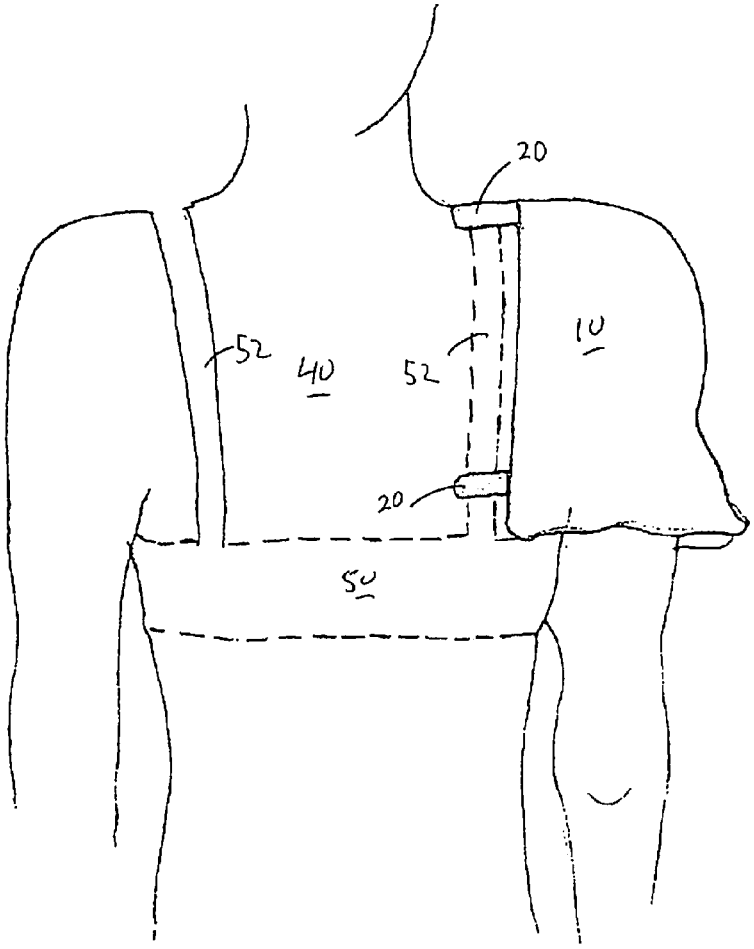
FIG. 3 is a rear elevational view of the mock sleeve (panel) of FIG. 1 attached to the strap of the bra as it drapes over the shoulder and upper arm area.

As seen in FIGS. 1-3 a first embodiment of a clip-on mock sleeve is shown and generally designated as reference numeral 10. Sleeve 10 is preferably designed specifically for use with sleeveless clothing, to give coverage or partial concealment in a fashionable manner to the shoulder and upper arm area of the wear. In one non-limiting embodiment, the fabric used for sleeve 10 can be constructed of a sheer chiffon-like material for easy draping over the shoulder. However, such is not considered limiting and other materials can also be used. When using a sheer fabric for the material a veil like appearance can be created and coordinates to mix and match with other fabrics and patterns. Preferably, the fabric can be lightweight and fluid so that it will lay delicately over the shoulder for a flattering short sleeve design. The fabric can be comprised of a synthetic blend for care and cleaning. As best seen in FIG. 1, in one non-limiting embodiment, the pattern of sleeve 10 can be shaped as substantially a half moon panel.

In one non-limiting embodiment, the length of sleeve 10 can be approximately 19" in length and approximately 10½" in width. Sleeve 10 is preferably secured to the strap 52 of the bra 50 being worn by the wearer 40. Sleeve 10 can be secured to bra strap 52 by various mechanisms in addition to the two embodiments illustrated and disclosed herein. In a first embodiment, a plurality of straps, such as elastic straps 20, can be used. One end of each strap 20 is permanently or removably secured to sleeve 10. Each strap is preferably provided with a securement mechanism, such as a mating snap mechanism 22. Other securement mechanism's can also be used, and are considered within the scope of the invention, such as, hook and loop fasteners, button/button hole(s), hooks/eyelets, etc.

In a preferred embodiment, sleeve/panel 10 can be comprised of three elastic straps 20, with snaps 22, with each strap 20 approximately 3" in length. Straps 20 line the diameter of the sleeve/panel 10 and are designed to snap for easy attachment and removal of sleeve 10. The perimeter of sleeve can be reinforced with a border 18, though such is not considered limiting.

Though not limiting, it is anticipated in most instances that a sleeve 10 will be worn over each shoulder/upper arm area of wearer 40.

Figure 4:
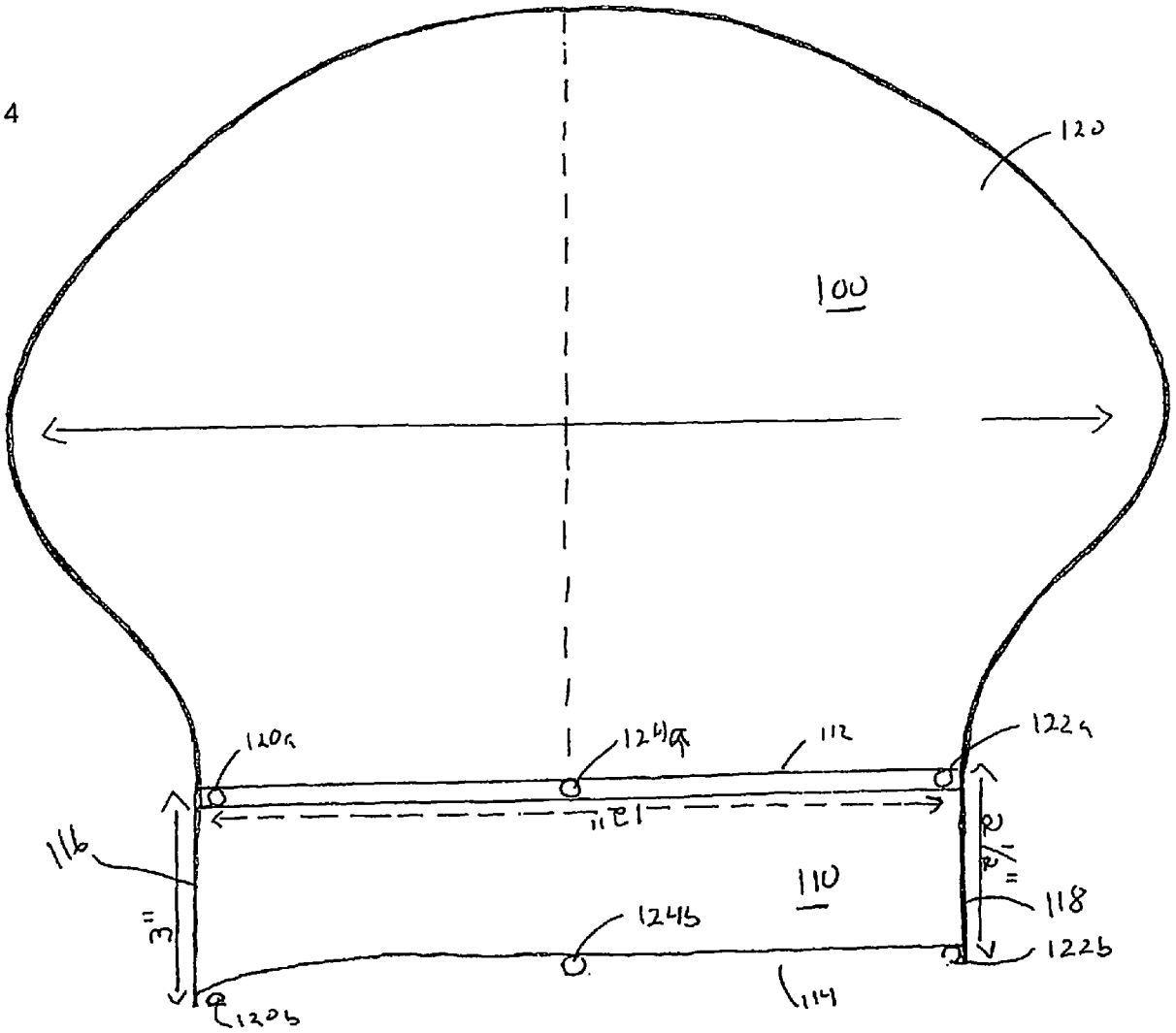
FIG. 4 is a top view of the mock sleeve (panel) in accordance with a second embodiment of the present invention shown in a flat position with non-limiting measurements provided that can be used in one embodiment.
Figure 5:
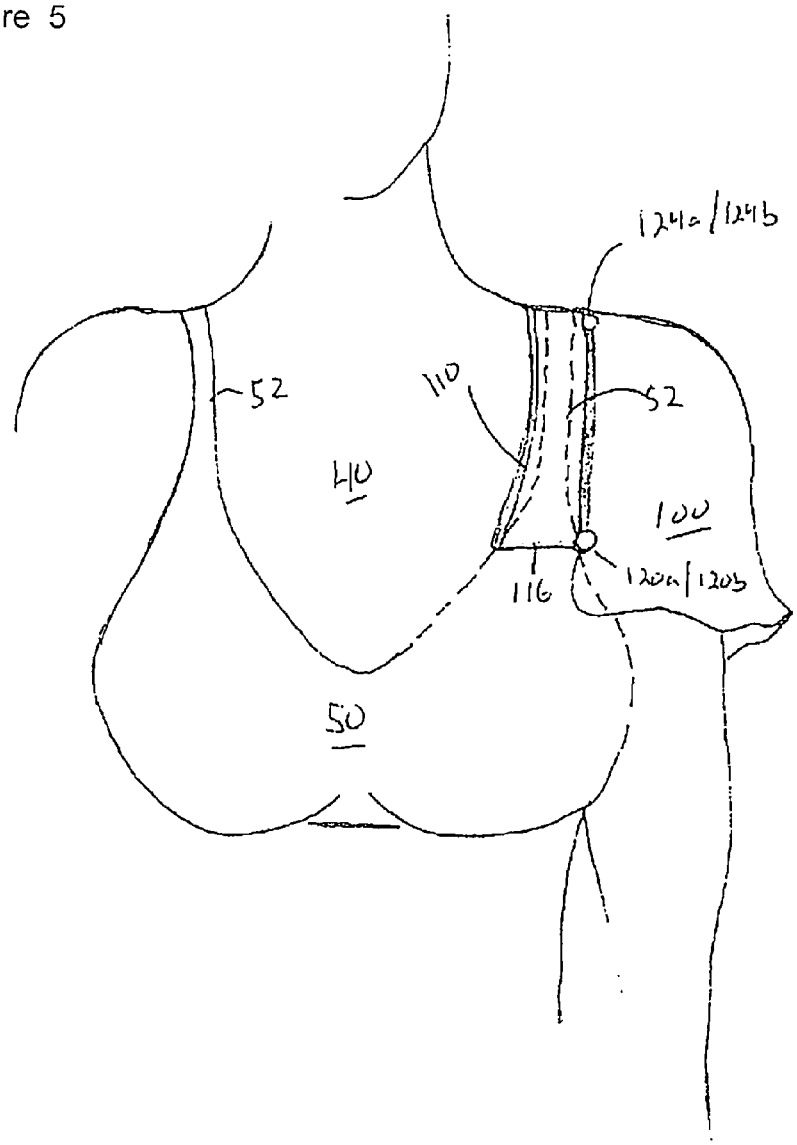
FIG. 5 is a front elevational view of the mock sleeve (panel) of FIG. 4 attached to the strap of the bra as it drapes over the shoulder and upper arm area.
Figure 6:
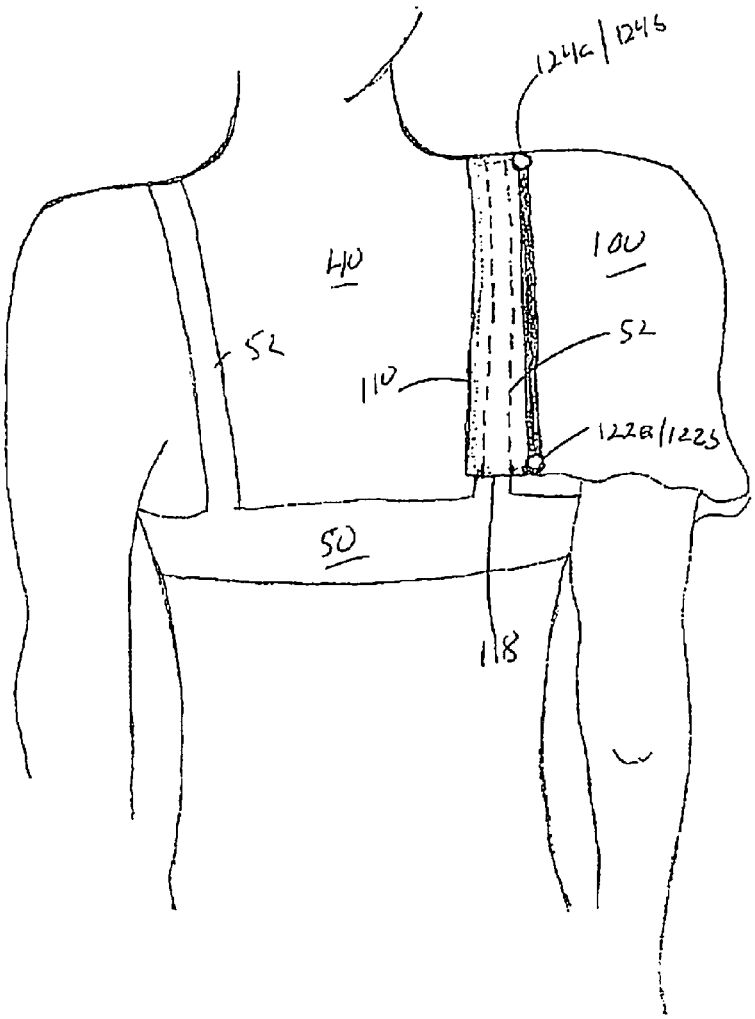
FIG. 6 is a rear elevational view of the mock sleeve (panel) of FIG. 4 attached to the strap of the bra as it drapes over the shoulder and upper arm area.

As seen in FIGS. 4-6 a second embodiment for the clip-on mock sleeve invention is shown and generally designated as reference numeral 100. Sleeve 100 is preferably designed specifically for use with sleeveless clothing, to give coverage or partial concealment in a fashionable manner to the shoulder and upper arm area of the wear. In one non-limiting embodiment, the fabric used for sleeve 100 can be constructed of a sheer chiffon-like material for easy draping over the shoulder. However, such is not considered limiting and other materials can also be used. When using a sheer fabric for the material a veil like appearance can be created and coordinates to mix and match with other fabrics and patterns. Preferably, the fabric can be lightweight and fluid so that it will lay delicately over the shoulder for a flattering short sleeve design. The fabric can be comprised of a synthetic blend for care and cleaning. As best seen in FIG. 4, in one non-limiting embodiment, the pattern of sleeve 100 can be shaped similar to a clam-shell shape.

In one non-limiting embodiment, the length of sleeve 100 can be approximately 18½" in length and approximately 10½" in width for its non panel portion. A portion 110, which can be a panel, of sleeve 100 can be reinforced at areas 112 and 114. Panel 110 can be attached by conventional means to portion 120 to form a one-piece clam-shell shape sleeve 100 or portions 110 and 120 can be monolithically formed or otherwise constructed from a single piece of material to form one-piece sleeve 100.

Portion 110 can be rectangular in shape. However, in a preferred embodiment, though resembling a rectangle in shape, portion 110 can have an end 116 larger in length as compared to its opposite end 118 in view of the bra increasing in width at the front as compared to the bra strap length. In one non-limiting embodiment, the length of the panel or portion 110 can be approximately 12" in horizontal length and approximately 3" in length at end 116 and approximately 2½" at end 118.

Figure 7:
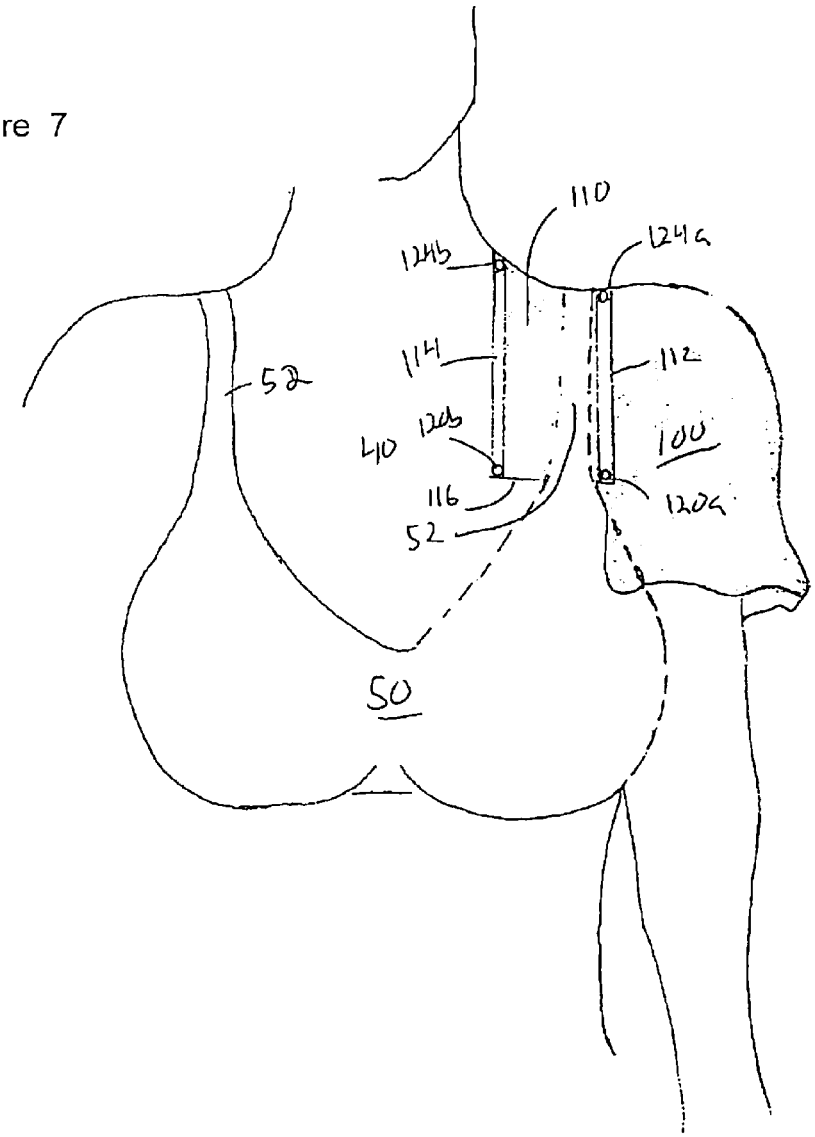
FIG. 7 is a front elevational view of the mock sleeve (panel) of FIG. 4 shown in an open position prior to complete attachment to the strap of the bra as it drapes over the shoulder and upper arm area.
Figure 8:
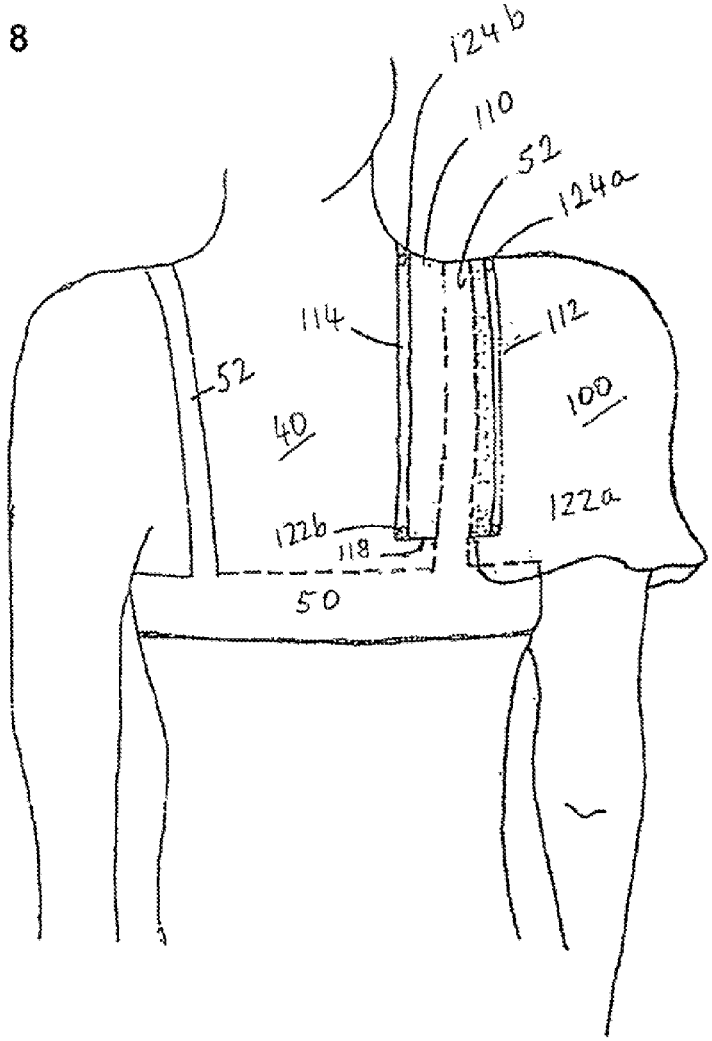
FIG. 8 a rear elevational view of the mock sleeve (panel) of FIG. 4 shown in an open position prior to complete attachment to the strap of the bra as it drapes over the shoulder and upper arm area.
Figure 9:
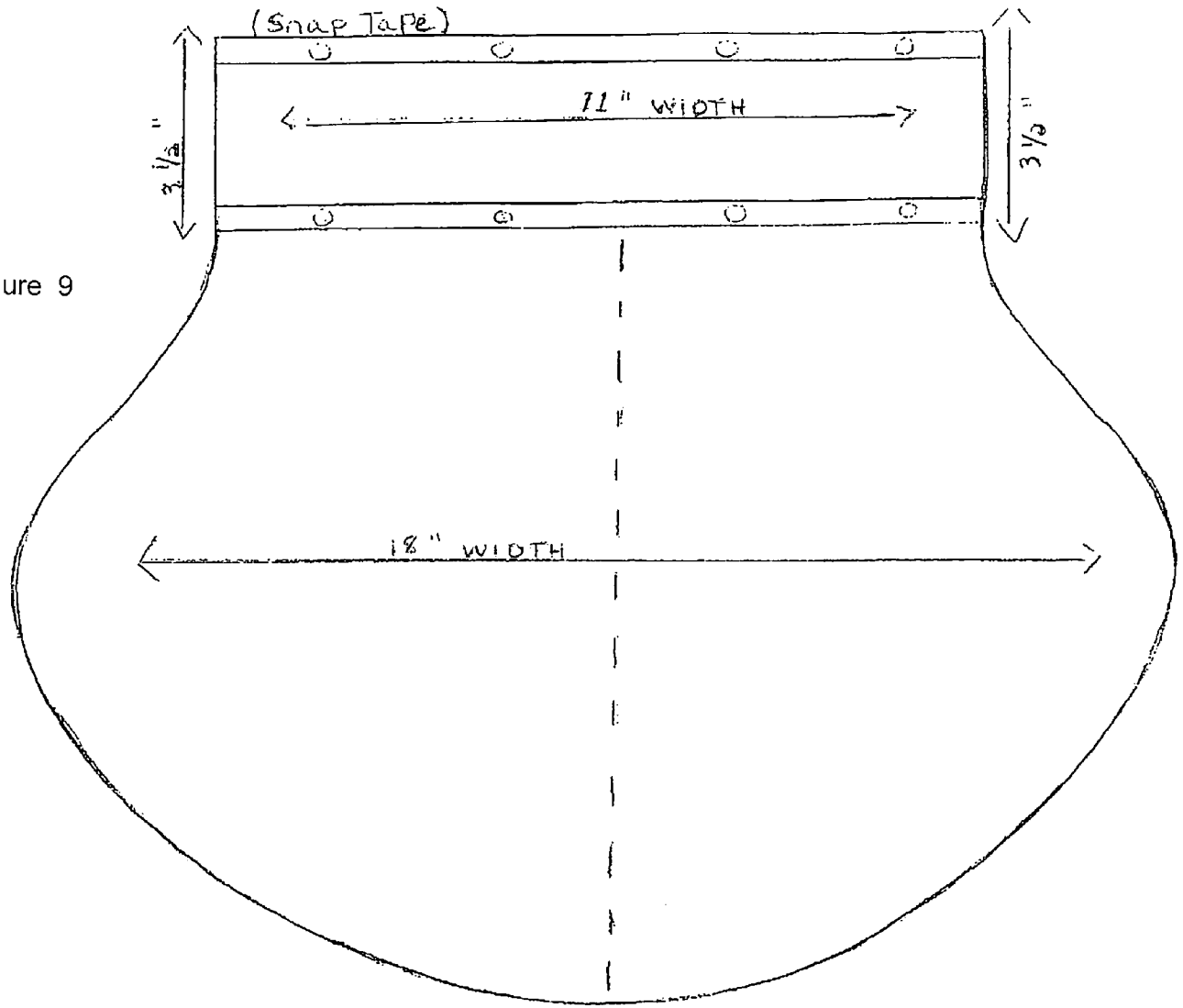
FIG. 9 is a top view of the mock sleeve (panel) in accordance with a third embodiment of the present invention shown in a flat position with non-limiting measurements provided that can be used in one embodiment.
Figure 10:
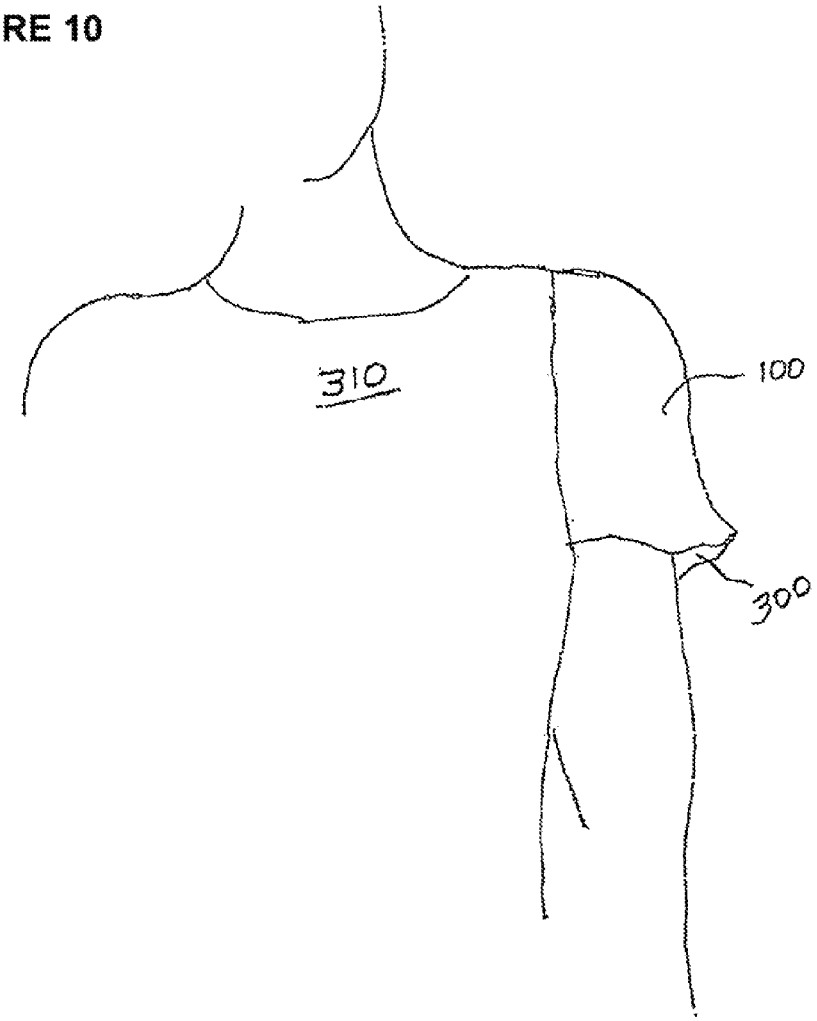
FIG. 10 is a front view illustrating the article of clothing covering the panel securement to the bra strap and showing the first fabric portion appearing as a sleeve for the article of clothing.

Sleeve 100 is preferably secured to the strap 52 of the bra 50 being worn by the wearer 40. In a second preferred securing embodiment for securing sleeve 100 to bra strap 52, panel 110 is tucked underneath strap 52 (FIGS. 7 and 8), with end 116 preferably in front (FIG. 7). Panel 110 is then folded over and preferably attached to itself, such that reinforced area 112 is at least substantially overlapping or at least substantially aligned with reinforced area 114 (FIGS. 5 and 6). In all embodiments using panel 110 or 110*a*, when securing the sleeve to the bra strap the panel is disposed around at least a portion of a bra strap, being worn by a wearer such that fabric portion of the sleeve is positioned over an outer shoulder and upper arm area of the wearer. This can be accomplished by inserting an outer end of the panel through a space defined between the bra strap and the wearer such that a first portion of the panel is disposed on a first side of the bra strap and a second portion of the panel is disposed on a second side of the bra strap (See FIGS. 7 and 8). As seen in FIGS. 7 and 8, the first fabric portion, drapes over the shoulder and at least the upper arm area of the wearer and the first fabric portion is open under the arm, which is evident by the space 300 (See FIG. 10) seen between the wearer's arm and the first portion. FIG. 10 also shows the article of clothing 310 covering or hiding the securement of the panel or straps around the bra strap, such that only the first fabric portion 100 is visible and appears as a sleeve for the article of clothing 310. The first portion of the panel can be folded over the bra strap (See FIGS. 5 and 6). As seen in FIGS. 4 and 9, the panel can have a top outer end where the first plurality of snaps are provided and a bottom end where the second plurality of snaps are provided. Further illustrated in FIGS. 4 and 9, the panel has a first side and a second side. The bottom end of the panel is positioned adjacent and along a bottom edge of the first portion (fabric material). As also seen in FIGS. 4 and 9, the top outer end and the bottom end of the panel are parallel to each other prior to securing the sleeve to the bra strap. The clam-shell shape of the first fabric portion can be created by having an intermediate area of the first fabric portion being wider in width as compared to a top area of the first fabric portion and a bottom area of the first fabric portion and a top edge of the first fabric portion being curved and a bottom edge of the first fabric portion being straight.

In one securement configuration, mating magnetic closures 120*a* and 120*b* and 122*a* and 122*b* can be attached or otherwise secured, by conventional means, to designated areas (i.e. preferably a respective corner of panel 110) of either reinforced member 112 or reinforced member 114 and a mating snap closure 124*a* and 124*b* can be secured to a designated area (i.e. preferably middle area) of either reinforced member 112 or reinforced member 114.

As seen in FIG. 9 a third embodiment for the clip-on mock sleeve invention is shown and generally designated as reference numeral 100*a*. Sleeve 100*a* is preferably designed specifically for use with sleeveless clothing, to give coverage or partial concealment in a fashionable manner to the shoulder and upper arm area of the wear. In one non-limiting embodiment, the fabric used for sleeve 100*a* can be constructed of a sheer chiffon-like material for easy draping over the shoulder. However, such is not considered limiting and other materials can also be used. When using a sheer fabric for the material a veil like appearance can be created and coordinates to mix and match with other fabrics and patterns. Preferably, the fabric can be lightweight and fluid so that it will lay delicately over the shoulder for a flattering short sleeve designs. The fabric can be comprised of a synthetic blend for care and cleaning. As best seen in FIG. 9, in one non-limiting embodiment, the pattern of sleeve 100*a* can be shaped similar to a clam-shell shape.

In one non-limiting embodiment, the length of sleeve 100*a* can be approximately 18" in length and approximately 10" in width for its non-panel portion. A portion 110*a*, which can be a panel, of sleeve 100*a* can be reinforced at areas 112*a* and 114*a*. Panel 110*a* can be attached by conventional means to portion 120*a* to form a one-piece clam-shell shape sleeve 100*a* or portions 110*a* and 120*a* can be monolithically formed or otherwise constructed from a single piece of material to form one-piece sleeve 100*a*.

Portion 110*a* can be rectangular in shape and can have a first end 116*a* and a second end 118*a*. End 116*a* can be larger in length than end 118*a* or they can be of the same or substantially the same length. In one non-limiting embodiment, the length of the panel or portion 110*a* can be approximately 11" in horizontal length and approximately 3" in length at end 116*a* and end 118*a*.

Sleeve 100*a* is preferably secured to the strap 52 of the bra 50 being worn by the wearer 40. In a third preferred securing embodiment for securing sleeve 100*a* to bra strap 52, panel 110*a* is tucked underneath strap 52, similar to panel 110 in FIGS. 7 and 8, with end 116*a* preferably in front, though such is not considered limiting, and end 119*a* can be in front. Panel 110*a* is then folded over and preferably attached to itself, such that reinforced area 112*a* is at least substantially overlapping or at least substantially aligned with reinforced area 114*a*, similar to the reinforced areas of panel 110 shown in FIGS. 5 and 6.

In the securement configuration shown in FIG. 9, a first piece of fabric tape such as, but not limited to, snap tape 117*a* can be disposed over and secured to reinforced area 112*a* or a first side portion of panel 110*a* if the area is not reinforced and similarly, a second piece of fabric tape, such as, but not limited to, snap tape 119*a* can be disposed over and secured to reinforced area 114*a* or a second side portion of panel 110*a* if the area is not reinforced.

Snap tape 117*a* can be provided with one or more snaps, preferably constructed from plastic, though such is not considered limiting. Preferably, a plurality of snaps can be provided on snap tape 117*a*. As seen in FIG. 9, in one non-limiting embodiment four snaps 130*a*, 132*a*, 134*a* and 136*a* can be provided, though such amount is not considered limiting and more or less snaps can be provided on snap tape 117*a*. Similarly, snap tape 119*a* can be provided with one more snaps, preferably constructed from plastic, though such is not considered limiting. Preferably, a plurality of snaps can be provided on snap tape 119*a*. As seen in FIG. 9, in one non-limiting embodiment four snaps 130*b*, 132*b*, 134*b* and 136*b* can be provided, though such amount is not considered limiting and more or less snaps can be provided on snap tape 119*a*. Preferably, an equal amount of snaps are provided on both snap tape 117*a* and 119*a*, though such is not considered limiting, and each snap on snap tape 117*a* mates with a corresponding designated snap on snap tape 119*a*, when sleeve 110*a* is secured to the bra strap in accordance with the present invention. For the embodiment shown in FIG. 9, snaps 130*a* and 130*b* mate together, snaps 132*a* and 132*b* mate together, snaps 134*a* and 134*b* mate together and snaps 136*a* and 136*b* mate together. Similar to the securement of sleeve 100, when securing sleeve 110*a*, panel 100 still folds over the bra strap when mating the corresponding snaps together.

In all embodiments, other securement mechanisms can also be used, and are considered within the scope of the invention, such as, hook and loop fasteners, clips, hooks, button/button hole(s), hooks/eyelets, all snaps, all magnetic closures, etc., as well as any combination of any of the various securement mechanisms.

Panel 110 or 110*a* used for attaching sleeve 100 or sleeve 100*a*, respectively, to bra 50 is designed for easy attachment and removal of sleeve 100 or 100*a*.

Preferably the material selected for sleeve 10, sleeve 100 and/or sleeve 100*a* can be a washable fabric. Sleeve 10, sleeve 100 and sleeve 100*a* are not considered limited to any specific size or color and various colors and sizes can be used and all are considered within the scope of the invention.

FIGS. 7 and 8 illustrating an open position for sleeve prior to attaching back to itself, would also work similar for the first embodiment of the present invention shown in FIGS. 1-3 or the embodiment shown in FIG. 9, with the straps being tucked underneath and then folded over instead of panel 110.

In a preferred embodiment, the present invention sleeve is independent and separate from any article clothing and not permanently secured to any article of clothing, including the bra strap. However, it is also considered within the scope of the invention to permanently secure the sleeve to the bra strap by any conventional means.

Though in a preferred embodiment, a short sleeve appearance is provided with the present invention, the present invention is not considered limited to any particular length and the design of the exposed portion of the sleeve can be of a longer or long sleeve configuration.

Preferably the panel 110 and/or 110*a* is either rectangular/substantially rectangular or square/substantially square in shape, though such is not considered limiting. Panel 110 and/or 110 can be permanently or removably secured to the remaining first portion of sleeve 100 and/100*a*. Similarly, straps 20 can be permanently or removably secured to the remaining first portion of sleeve 10.

Features or components discussed for one embodiment of the present invention sleeve are also considered to be used in other embodiments for the present invention sleeve even if not specifically discussed above.

All measurements, dimensions, amounts, sizes, shapes, percentages, configurations, securement or attachment mechanisms, numbers, ranges, values, percentages, materials, orientations, methods of manufacture, etc. discussed above or shown in the drawing figures are merely by way of example and are not considered limiting and other measurements, dimensions, amounts, sizes, shapes, percentages, configurations, securement or attachment mechanisms, numbers, ranges, values, percentages, materials, orientations, methods of manufacture, etc. can be chosen and used and all are considered within the scope of the invention.

Dimensions of certain parts as shown in the drawings may have been modified and/or exaggerated for the purpose of clarity of illustration and are not considered limiting. Component values shown in the drawings, including the electrical schematics, are merely examples of component values and part numbers that can be used and the present invention is not considered limited to these specific component values and part numbers.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A method for removably securing a sleeve to a bra strap to give the appearance that a sleeveless article of clothing worn by a wearer has a sleeve, the sleeve being separate and not secured to the article of clothing, said sleeve having a first fabric portion and a single elongated panel secured to the first fabric portion along a bottom edge of the first fabric portion, a first plurality of snaps are provided on a top outer end of said panel and a second plurality of snaps are provided on a bottom end of said panel, said bottom end positioned adjacent and along the bottom edge of the first fabric portion, said top outer end and said bottom end are parallel to each other prior to securing the sleeve to the bra strap; said method comprising the steps:

(a) disposing the single elongated panel around at least a portion of a bra strap being worn by a wearer such that the first fabric portion is positioned and drapes over an outer shoulder and upper arm area of the wearer; and (b) securing a first portion of the single elongated panel to a second portion of the single elongated panel by mating the first plurality of snaps with the second plurality of snaps which maintains the first fabric portion in place and draped over the outer shoulder and upper arm area of the wearer.

2. The method for removably securing a sleeve to a bra strap of claim 1 further comprising the step of:

disposing the sleeveless article of clothing on the wearer such that the disposal and securement of the panel around the bra strap is hidden and at least some of the first fabric portion remains exposed.

3. The method of claim 1 wherein step (a) comprises the steps of:

(a1) inserting the top outer end of the panel through a space defined between the bra strap and the wearer such that a first portion of the panel is disposed on a first side of the bra strap and a second portion of the panel is disposed on a second side of the bra strap; and (a2) folding the first portion of the panel over the bra strap.

4. The method of claim 1 wherein said sleeve has a semi-circular cross sectional shape prior to securing the sleeve to the bra strap.

5. The method of claim 1 wherein said sleeve has a clamshell cross sectional shape prior to securing the sleeve to the bra strap, said clamshell shape of the first fabric portion created by having an intermediate area of the first fabric portion wider in width as compared to a top area of the first fabric portion and a bottom area of the first fabric portion and a top edge of the first fabric portion being curved and the bottom edge of the first fabric portion being straight.

6. The method of claim 1 wherein the first plurality of snaps are all secured to a first single piece of snap tape and said first single piece of snap tape is secured to the top outer end of the panel such that the first single piece of snap tape extends from a first side of the panel to a second side of the panel and the second plurality of snaps are all secured to a second single piece of snap tape and said second single piece of snap tape is secured to the bottom end of the panel such that the second single piece of snap tape extends from the first side of the panel to the second side of the panel.

7. The method of claim 6 further comprising the step of:

disposing the sleeveless article of clothing on the wearer such that the disposal and securement of the panel around the bra strap is hidden and at least some of the first fabric portion remains exposed.

8. The method of claim 1 wherein a first side of the panel having a first length and a second side of the panel having a second length, wherein the first length of the first side of the panel being longer in dimension than the second length of the second side of the panel.

9. The method of claim 1 wherein said first fabric portion is constructed from a chiffon fabric material.

10. A method for removably securing a sleeve to a bra strap to give the appearance that a sleeveless article of clothing worn by a wearer has a sleeve, the sleeve being separate and not secured to the article of clothing, said sleeve having a first fabric portion and a single elongated panel secured to the first fabric portion along a bottom edge of the first fabric portion, a first plurality of securement members are provided on a top outer end of said panel and a second plurality of securement members are provided on a bottom end of said panel, said bottom end positioned adjacent and along the bottom edge of the first fabric portion, said top outer end and said bottom end are parallel to each other prior to securing the sleeve to the bra strap; said method comprising the steps:

(a) disposing the single elongated panel around at least a portion of a bra strap being worn by a wearer such that the first fabric portion is positioned and drapes over an outer shoulder and upper arm area of the wearer; and (b) securing a first portion of the single elongated panel to a second portion of the single elongated panel by mating the first plurality of securement members with the second plurality of securement members which maintains the first fabric portion in place over the outer shoulder and upper arm area of the wearer.

11. The method of claim 10 wherein the first plurality of securement members are a first plurality of magnets and the second plurality of securement members are a second plurality of magnets.

12. The method of claim 10 wherein the first plurality of securement members are a first plurality of snaps all secured to a first single piece of snap tape and said first single piece of snap tape is secured to the top outer end of the panel such that the first single piece of snap tape extends from a first side of the panel to a second side of the panel and the second plurality of securement members are a second plurality of snaps all secured to a second single piece of snap tape and said second piece of snap tape is secured to the bottom end of the panel such that the second single piece of snap tape extends from the first side of the panel to the second side of the panel.

13. The method of claim 10 wherein said sleeve has a semi-circular cross sectional shape prior to securing the sleeve to the bra strap.

14. The method of claim 10 wherein said sleeve has a clamshell cross sectional shape prior to securing the sleeve to the bra strap, said clamshell shape of the first fabric portion created by having an intermediate area of the first fabric portion wider in width as compared to a top area of the first fabric portion and a bottom area of the first fabric portion and a top edge of the first fabric portion being curved and the bottom edge of the first fabric portion being straight.

15. The method of claim 10 wherein step (a) comprises the steps of:

(a1) inserting the top outer end of the panel through a space defined between the bra strap and the wearer such that a first portion of the panel is disposed on a first side of the bra strap and a second portion of the panel is disposed on a second side of the bra strap; and (a2) folding the first portion of the panel over the bra strap.

16. The method of claim 10 further comprising the step of:

disposing the sleeveless article of clothing on the wearer such that the disposal and securement of the panel around the bra strap is hidden and at least some of the first fabric portion remains exposed.

17. The method of claim 10 wherein a first side of the panel having a first length and a second side of the panel having a second length, wherein the first length of the first side of the panel being longer in dimension than the second length of the second side of the panel.

18. The method of claim 10 wherein said first fabric portion is constructed from a chiffon fabric material.

19. A method for removably securing a sleeve to a bra strap to give the appearance that a sleeveless article of clothing worn by a wearer has a sleeve, the sleeve being separate and not secured to the article of clothing, said sleeve having a first fabric portion and a plurality of securement straps secured to the first portion, each of said plurality of securement straps having a first securement portion and a corresponding second securement portion; said method comprising the steps:

(a) disposing the plurality of securement straps around at least a portion of a bra strap being worn by a wearer such that the first fabric portion is positioned and drapes over an outer shoulder and upper arm area of the wearer; and (b) securing the first portions of the plurality of securement straps to the second portions of the plurality of securement straps or the first fabric portion by mating the first securement portions with the second securement portions which maintains the first fabric portion in place and draped over the outer shoulder and upper arm area of the wearer.

20. The method of claim 19 wherein said first fabric portion is constructed from a chiffon fabric material.

* * * * *